US008593044B2

(12) United States Patent
Grajcar

(10) Patent No.: US 8,593,044 B2
(45) Date of Patent: Nov. 26, 2013

(54) MODULAR ARCHITECTURE FOR SEALED LED LIGHT ENGINES

(75) Inventor: Zdenko Grajcar, Crystal, MN (US)

(73) Assignee: ONCE Innovations, Inc., Plymouth, MN (US)

( * ) Notice: Subject to any disclaimer, the term of this patent is extended or adjusted under 35 U.S.C. 154(b) by 221 days.

(21) Appl. No.: 13/011,927

(22) Filed: Jan. 23, 2011

(65) Prior Publication Data

US 2011/0193467 A1 Aug. 11, 2011

Related U.S. Application Data

(60) Provisional application No. 61/298,410, filed on Jan. 26, 2010, provisional application No. 61/298,289, filed on Jan. 26, 2010.

(51) Int. Cl.
*H01J 5/16* (2006.01)

(52) U.S. Cl.
USPC ..... 313/113; 362/217.01; 362/294.02; 362/294; 362/362

(58) Field of Classification Search
USPC ..... 362/345, 249.01–249.03, 217.01, 362/217.1; 313/113
See application file for complete search history.

(56) References Cited

U.S. PATENT DOCUMENTS

| | | | | |
|---|---|---|---|---|
| 6,536,924 | B2 * | 3/2003 | Segretto | 362/345 |
| 8,147,091 | B2 * | 4/2012 | Hsia et al. | 362/221 |
| 2006/0285325 | A1 * | 12/2006 | Ducharme et al. | 362/231 |
| 2008/0013316 | A1 * | 1/2008 | Chiang | 362/264 |
| 2011/0038148 | A1 * | 2/2011 | Pyle | 362/235 |
| 2012/0218746 | A1 * | 8/2012 | Winton | 362/219 |

OTHER PUBLICATIONS

International Preliminary Report on Patentability and Written Opinion issued in International Patent Application No. PCT/US2011/022299 dated Aug. 9, 2012.

* cited by examiner

*Primary Examiner* — Donald Raleigh
(74) *Attorney, Agent, or Firm* — McDermott Will & Emery LLP

(57) ABSTRACT

Apparatus and associated methods involve an assembly of multiple LED light engines in which a desired number of LED lamps are mounted to a plate that forms a wall of an enclosure. In an illustrative example, three LED light engines may be mounted to a plate that may be slidably installed as a wall of an extruded housing that contains electrical connections from an AC power inlet to each light engine. In various examples, the number and layout arrangement of the LED light engines may be custom selected for a particular application.

10 Claims, 17 Drawing Sheets

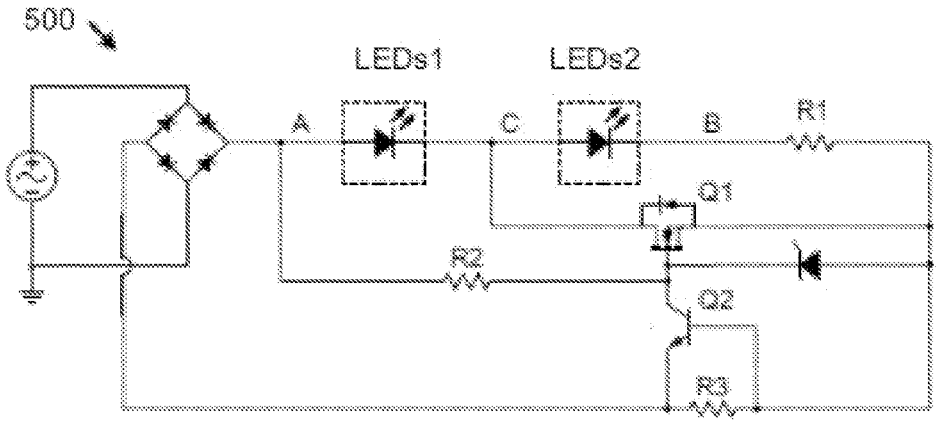
FIG. 5A
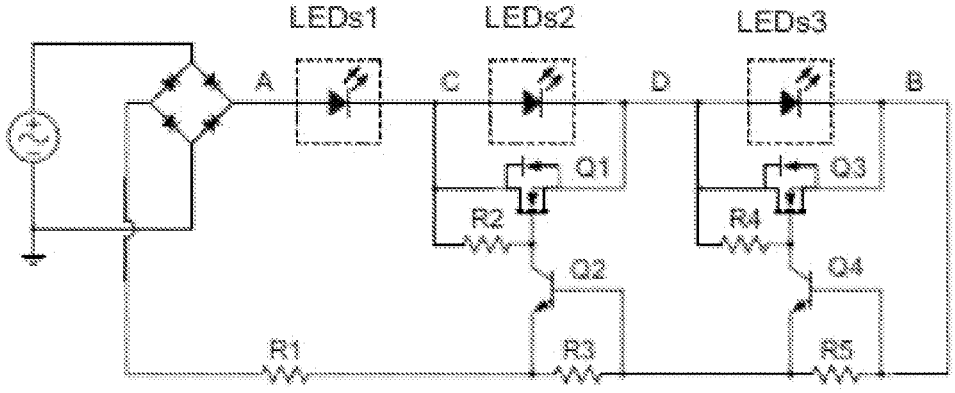
FIG. 5B
FIG. 5A-5B

700

MODULAR ARCHITECTURE FOR SEALED LED LIGHT ENGINES

CROSS-REFERENCE TO RELATED APPLICATIONS

This application claims priority to U.S. Provisional Patent Application entitled "Modular Architecture for Sealed LED Light Engines," Ser. No. 61/298,410, which was filed by Z. Grajcar on Jan. 26, 2010, and to U.S. Provisional Patent Application entitled "Sealed LED Light Engines," Ser. No. 61/298,289, which was filed by Z. Grajcar on Jan. 26, 2010, the entire contents of each of which are incorporated herein by reference.

TECHNICAL FIELD

Various embodiments relate generally to methods and apparatus involving LED-based lighting.

BACKGROUND

Lighting can be an important consideration in some applications. In commercial or residential lighting, for example, various types of lighting systems have been commonly used for general illumination. For example, common lighting systems that have been used include incandescent or fluorescent lamps.

More recently, LEDs (light emitting diodes) are becoming widely used devices capable of illumination when supplied with current. Typically, an LED is formed as a semiconductor diode having an anode and a cathode. In theory, an ideal diode will only conduct current in one direction. When sufficient forward bias voltage is applied between the anode and cathode, conventional current flows through the diode. Forward current flow through an LED may cause photons to recombine with holes to release energy in the form of light.

The emitted light from some LEDs is in the visible wavelength spectrum. By proper selection of semiconductor materials, individual LEDs can be constructed to emit certain colors (e.g., wavelength), such as red, blue, or green, for example.

In general, an LED may be created on a conventional semiconductor die. An individual LED may be integrated with other circuitry on the same die, or packaged as a discrete single component. Typically, the package that contains the LED semiconductor element will include a transparent window to permit the light to escape from the package.

SUMMARY

Apparatus and associated methods involve an assembly of multiple LED light engines in which a desired number of LED lamps are mounted to a plate that forms a wall of an enclosure. In an illustrative example, three LED light engines may be mounted to a plate that may be slidably installed as a wall of an extruded housing that contains electrical connections from an AC power inlet to each light engine. In various examples, the number and layout arrangement of the LED light engines may be custom selected for a particular application.

In one exemplary aspect, a method of fabricating a light source includes providing a predetermined number of sealed light engine modules (SLEM). Each light engine includes a base for mounting the SLEM, each base comprising an electrical interface for coupling the SLEM to an electric source, a light chamber sealed to substantially resist the ingress of contaminants, an illumination source disposed within the sealed light chamber; and, an electronic conditioning module to receive electrical excitation from the electrical interface and to supply conditioned electrical excitation to the illumination source. The method further includes providing a first enclosure member with opposing first and second walls and a third wall connecting the first and second walls, and a second enclosure member comprising a plate with a number of apertures sized to receive the base of one of the SLEMs. The method also includes installing the base of each of the provided sealed light engine modules into a corresponding one of the apertures on the second enclosure member, and slidably engaging the first and second enclosure members to form an enclosed volume that substantially contains the electrical interface of each of the installed SLEMs.

In some examples, the method may further include installing an end cap at each opposing open end of the enclosed volume. The method may further include making electrical connection to a pluggable socket for making connection to an excitation source. The method may further include performing the step of making electrical connection to the pluggable socket before performing the step of slidably engaging the first and second enclosure members. The method may further include selecting the predetermined number of SLEMs to meet a specified light output level.

The method may further include engaging the light chamber to the base with at least one screw in each of the SLEMs, or securing the illumination source to the light chamber with the at least one screw in each of the SLEMs.

In another exemplary aspect, a light source include a predetermined number of sealed light engine modules (SLEM). Each light engine includes a base for mounting the SLEM, each base comprising an electrical interface for coupling the SLEM to an electric source, a light chamber sealed to substantially resist the ingress of contaminants, an illumination source disposed within the sealed light chamber, and an electronic conditioning module to receive electrical excitation from the electrical interface and to supply conditioned electrical excitation to the illumination source. The light source further includes a first enclosure member with opposing first and second walls and a third wall connecting the first and second walls, a second enclosure member comprising a plate with a number of apertures sized to receive the base of one of the SLEMs. The base of each of the provided sealed light engine modules is installed into a corresponding one of the apertures on the second enclosure member. The first and second enclosure members are adapted to slideably engage to form an enclosed volume that substantially contains the electrical interface of each of the installed SLEMs.

In some examples, the light source may include a translucent lens opposite the base, and the lens may include an optical diffusive material. A color temperature of at least one of the SLEMs may be a substantially smooth and continuous function of an amplitude of the electrical excitation. The conditioning module may modulate a color temperature of at least one of the SLEMs is a substantially smooth and continuous function of a phase modulation of the electrical excitation. The SLEM may include a parabolic reflector.

Various embodiments may achieve one or more advantages. For example, some embodiments enclose the LEDs in a sealed light chamber and may be capable of robust operation in a wide range of environments, such as environments with direct exposure to chemical contaminants, dust, or water, for example. Some embodiments may provide thermal management of the LED junctions in the sealed light chamber to promote long service life, for example, up to 100,000 hours or more. Various examples may operate with high efficiency and power quality, such as with power factor substantially above 0.97 and/or total harmonic distortion substantially below 25%, in some examples. Various implementations may substantially reduce labor costs by featuring simplified assembly operations, and substantially reduced materials costs by featuring low parts count. Various embodiments may provide an environmentally friendly lighting solution, for example, with high luminous efficacy of up to at least 70-150 lumens/watt, but substantially no mercury.

The details of various embodiments are set forth in the accompanying drawings and the description below. Other features and advantages will be apparent from the description and drawings, and from the claims.

BRIEF DESCRIPTION OF THE DRAWINGS

FIG. 5A shows a schematic of an exemplary circuit for an LED light engine with selective current diversion to bypass a group of LEDs while AC input excitation is below a predetermined level.

FIG. 5B depicts a schematic of an exemplary circuit for an LED light engine with selective current diversion to bypass two groups of LEDs while AC input excitation is below two corresponding predetermined levels.

Like reference symbols in the various drawings indicate like elements.

DETAILED DESCRIPTION OF ILLUSTRATIVE EMBODIMENTS

Figure 1:
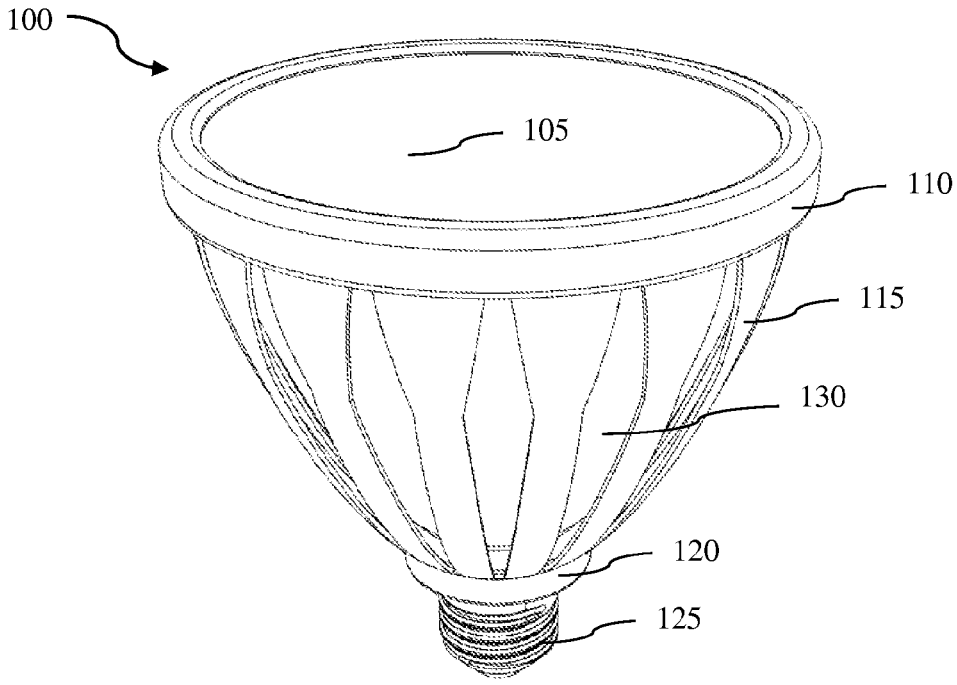
FIGS. 1-2 show an exemplary embodiment of an LED light engine assembled as a lamp.
Figure 2:
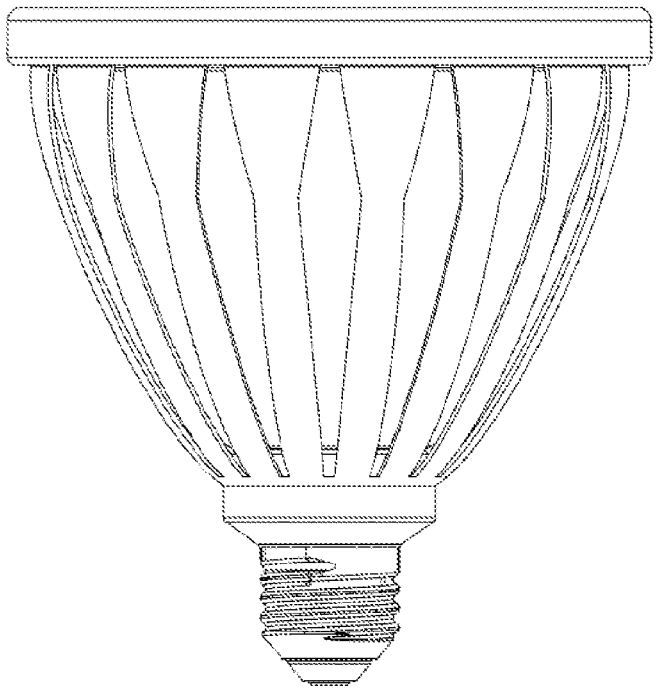
Figure 3:
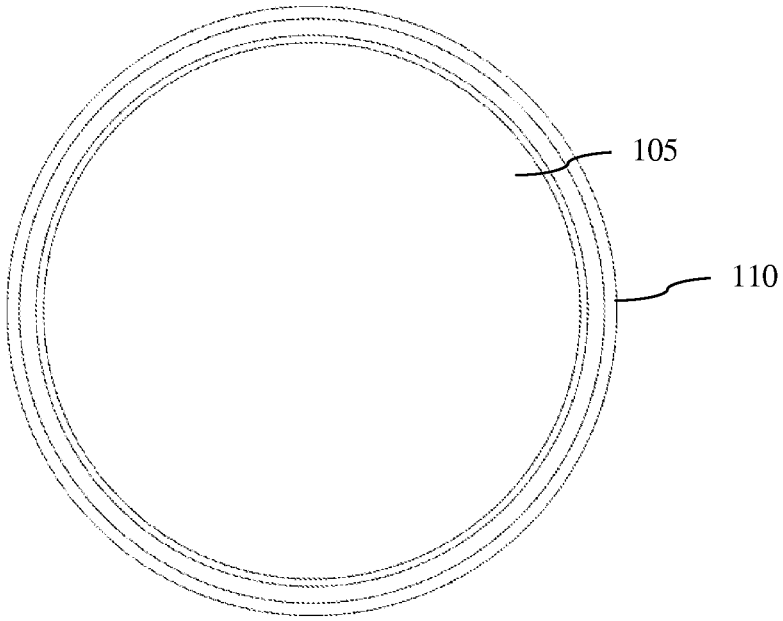
FIGS. 3-4 show distal and proximal views of the lamp assembly of FIG. 1.
Figure 4:
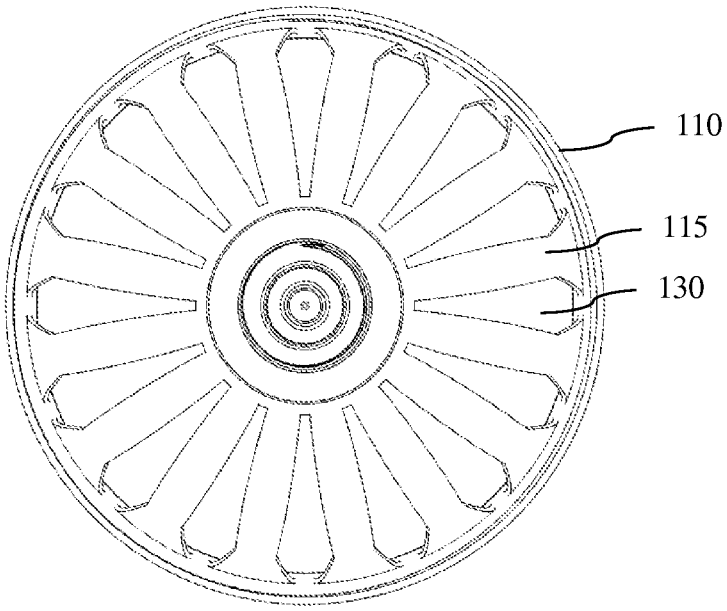

This document discloses, with reference to various embodiments, LED lamp assemblies that include a light engine that may be considered substantially sealed against ingress of contaminants, such as liquids (e.g., water spray), dust, or other various contaminants. Certain examples described herein further include integrated thermal management features to provide a low thermal impedance path for transferring heat away from the components within an exemplary sealed light engine.

Unless indicated otherwise, a light engine may generally be understood as a module that receives an electrical energy as an input and converts the received energy to a light output. In some examples, a light engine may further include components that shape the light output, for example, into a beam.

To aid understanding, this document is generally organized as follows. First, to help introduce discussion of various embodiments, an example LED (light emitting diode) lamp assembly that includes a sealed light engine is described with reference to FIGS. 1-4. Next, with reference to FIGS. 5-7, this document describes examples of light engine circuits for providing dimmable light output and/or dynamic color temperature responsive to controlled AC input excitation (e.g., phase control). Then, construction and assembly of the previously introduced exemplary lamp assembly are described with reference to FIGS. 8-11. Finally, with reference to FIGS. 12-19, construction of a further exemplary embodiment of an LED lamp assembly with a sealed light engine is described.

FIGS. 1-4 show an exemplary embodiment of an LED light engine assembled as a lamp 100. By way of illustrative example and not limitation, the depicted lamp may be sized for compatibility or replacement of a PAR 30 or PAR 38 style lamp with an Edison base.

The lamp 100 includes a lens 105, a sealing ring 110, and a body shell 115. The body shell 115 may provide substantial protection for a light engine (not shown in this figure) from external damage, for example, due to drops or blunt forces. At the distal end of the lamp 100, the sealing ring 110 may mate with the lens 105 and the body shell 115. At the proximal end of the lamp 100, the body shell 115 is seated on a distal end of a base member 120. A socket cup 125 is fitted to a proximal end of the base member 120.

The lens 105 may be substantially transparent to provide a path for light exiting the sealed light chamber. In some examples, the lens may be made substantially of a plastic film or glass substrate, for example. By way of example and not limitation, the lens may be formed in whole or part of polyester, polycarbonate, acrylic, glass, fused silica, or a combination of such substrates. In some examples, optical properties of the lamp may be modified by a process such as sand blasting. In some examples, a film may be deposited (e.g., as a sheet or by spray) on at least a portion of the lens substrate, which may be glass or plastic, for example. Diffuser films are commercially available, for example, from Luminit LLC of Torrance, Calif. In one implementation, a holographic diffuser may be applied as a film to one or both surfaces of the lens. The lens may include a Fresnel lens. The lens may be substantially flat in some examples.

The sealing ring 110 retains the lens 105 to a distal end of the reflector 130. The lens 105, sealing ring 110, and reflector 130 forms a substantially sealed light chamber that houses an LED module, an example of which is shown, for example, in FIG. 8. The sealed light chamber may advantageously inhibit or substantially resist the ingress of contaminants or foreign objects. In some examples, the seal may resist ingress of water, such as may be sprayed from a hose, for example.

The body shell 115 may be formed of a metal that provides a low thermal impedance path. By way of example and not limitation, the body shell 115 may be formed of one or metals that may include iron, steel, aluminum, brass, or copper. In some embodiments, the body shell 115 may have an anodized finish. An anodized finish may increase the electrical resistance at the interface between the metal members and the exterior surface accessible to a user.

The socket cup 125 is depicted as being a screw-type interface for a threaded outlet. The socket cup 125 has a radial terminal for making electrical contact to a corresponding radial terminal in the threaded outlet, and has an axial terminal for making electrical contact to a corresponding terminal along the longitudinal axis of the lamp 100.

In another embodiment, the lamp 100 may include a prong-style electrical interface, such as those that may be used for track-style lighting. By way of example and not limitation, the socket cup 125 may be replaced with the connector style used in GU-10 lamps. In yet another embodiment, the lamp 100 may include a blade-style electrical interface. In various examples, the lamp 100 may include male and/or female configurations for making electrical connection to a powered socket.

The reflector 130 may be formed substantially of a metal material. In various embodiments, the reflector 130 may provide substantial thermal conductivity and surface area, which may advantageously promote transfer of heat energy away from the light engine components, for example, by conduction, radiation, and/or convection. By way of example, and not limitation, the reflector 130 may be formed substantially from copper, gold, silver, aluminum, steel, iron, brass, bronze, tin, or a combination of these or other materials that may form suitable optical and/or thermal conductivity properties for the light chamber. Some embodiments of the reflector 130 may include a plastic coated on its interior and/or exterior surfaces with a thermally conductive and reflective metal, such as copper plating. In an illustrative example, the interior surface of the reflector 130 that forms part of the light chamber may be finished with a highly reflective surface to enhance optical performance. In another example, the interior surface may be sand blasted to provide a roughened surface to promote light diffusion. In a further example, the interior surface may be brushed to improve light diffusion.

Turning to an exemplary electrical circuit for a sealed LED light engine, FIG. 5A shows a schematic of an exemplary circuit for an LED light engine with selective current diversion to bypass a group of LEDs while AC input excitation is below a predetermined level. Various embodiments may advantageously yield improved power factor and/or a reduced harmonic distortion for a given peak illumination output from the LEDs.

The light engine circuit of FIG. 5A includes a bridge rectifier and two groups of LEDs: LEDs1 and LEDs2 each contain multiple LEDs. In operation, each group of LEDs1, 2 may have an effective forward voltage that is a substantial fraction of the applied peak excitation voltage. Their combined forward voltage in combination with a current limiting element may control the forward current. The current limiting element may include, for example, a fixed resistor, current controlled semiconductor, temperature-sensitive resistors, or the like.

The light engine circuit further includes a bypass circuit that operates to reduce the effective forward turn-on voltage of the circuit. In various embodiments, the bypass circuit may contribute to expanding the conduction angle at low AC input excitation levels, which may tend to benefit power factor and/or harmonic factor, e.g., by constructing a more sinusoidally-shaped current waveform.

The bypass circuit includes a bypass transistor (e.g., MOSFET, IGBT, bipolar, or the like) with its channel connected in parallel with the LEDs2. The conductivity of the channel is modulated by a control terminal (e.g., gate of the MOSFET). In the depicted example, the gate is pulled up in voltage through a resistor to a positive output terminal of the rectifier, but can be pulled down to a voltage near a voltage of the source of the MOSFET by a collector of an NPN transistor. The NPN transistor may pull down the MOSFET gate voltage when a base-emitter of the NPN transistor is forward biased by sufficient LED current through a sense resistor.

The depicted example further includes an exemplary protection element to limit the gate-to-source voltage of the MOSFET. In this example, a zener diode (e.g., 14V breakdown voltage) may serve to limit the voltage applied to the gate to a safe level for the MOSFET.

FIG. 5B depicts a schematic of an exemplary circuit for an LED light engine with selective current diversion to bypass two groups of LEDs while AC input excitation is below two corresponding predetermined levels. The light engine circuit of FIG. 5B adds an additional group of LEDs and a corresponding additional bypass circuit to the light engine circuit of FIG. 5A. Various embodiments may advantageously provide for two or more bypass circuits, for example, to permit additional degrees of freedom in constructing a more sinusoidally-shaped current waveform. Additional degrees of freedom may yield further potential improvements to power factor and further reduced harmonic distortion for a given peak illumination output from the LEDs.

Figure 6A:
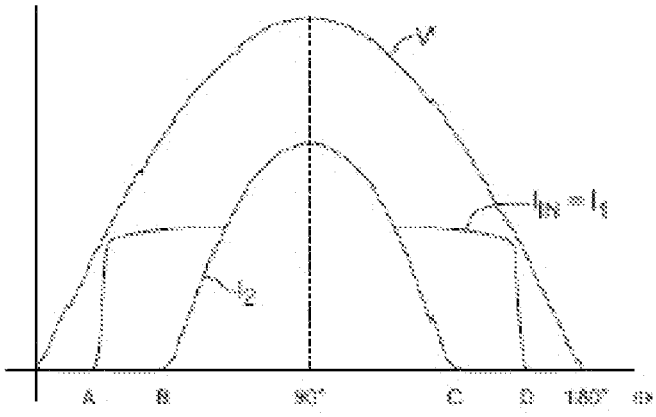
FIGS. 6A-6C depict exemplary electrical and light performance parameters for the light engine circuit of FIG. 5A.
Figure 6B:
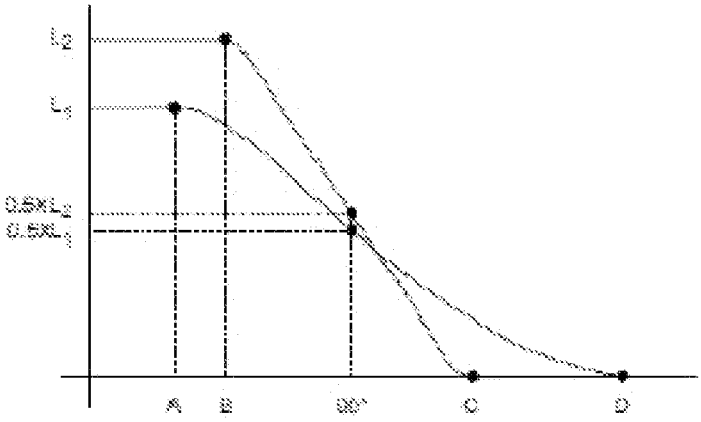
Figure 6C:
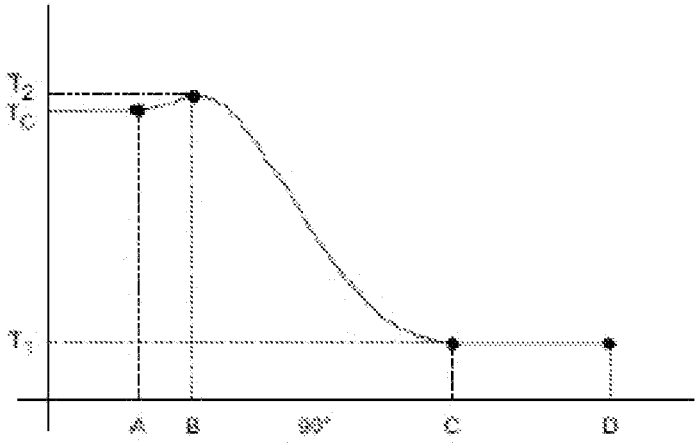

FIGS. 6A-6C depict exemplary electrical and light performance parameters for the light engine circuit of FIG. 5A.

FIG. 6A depicts illustrative voltage and current waveforms for the light engine circuit of FIG. 5A. The graph labeled V plots the AC input excitation voltage, which is depicted as a sinusoidal waveform. The plot labeled Iin=I1 shows an exemplary current waveform for the input current, which in this circuit, is the same as the current through LEDs1. A plot labeled 12 represents a current through the LEDs2.

During a typical half-cycle, LEDs1 do not conduct until the AC input excitation voltage substantially overcomes the effective forward turn on for the diodes in the circuit. When the phase reaches A in the cycle, current starts to flow through the LEDs1 and the bypass switch. Input current increase until the bypass circuit begins to turn off the MOSFET at B. In some examples, the MOSFET may behave in a linear region (e.g., unsaturated, not rapidly switching between binary states) as the current divides between the MOSFET channel and the LEDs2. The MOSFET current may fall to zero as the current I2 through LEDs2 approaches the input current. At the peak input voltage excitation, the peak light output is reached. These steps occur in reverse after the AC input excitation voltage passes its peak and starts to fall.

FIG. 6B depicts an illustrative plot of exemplary relationships between luminance of the LEDs1 and LEDs2 in response to phase control (e.g., dimming). The relative behavior of output luminance of each of LEDs1 and LEDs2 will be reviewed for progressively increasing phase cutting, which corresponds to dimming.

At the origin and up to conduction angle A, phase control does not attenuate any current flow through LEDs1 or LEDs2. Accordingly, the LEDs1 maintains its peak luminance L1, and the LEDs2 maintains its peak luminance L2.

When the phase control delays conduction for angles between A and B, an average luminance of LEDs1 is decreased, but the phase control does not impact the current profile through LEDs2, so LEDs2 maintains luminance L2.

When the phase control delays conduction for angles between B and C, an average luminance of LEDs1 continues to fall as the increase in phase cutting continues to shorten the average illumination time of the LEDs1. The phase control also begins to shorten the average conduction time of the LEDs2, so L2 luminance falls toward zero as the phase control turn-on delay approaches C.

When the phase control delays conduction for angles between C and D, the phase controller completely blocks current during the time the excitation input level is above the threshold required to turn off the bypass switch. As a consequence, LEDs2 never carries current and thus outputs no light. LEDs1 output continues to fall toward zero at D.

At phase cutting beyond D, the light engine puts out substantially no light because the excitation voltage levels supplied by the phase controller are not sufficient to overcome the effective forward turn on voltage of the LEDs1.

FIG. 6C depicts an exemplary composite color temperature characteristic under phase control for the LED light engine of FIG. 6A. In this example, LEDs1 and LEDs2 that have different colors, T1 and T2, respectively. The luminance behavior of LEDs1 and LEDs2 as described with reference to FIG. 6B indicates that an exemplary light engine can shift its output color as it is dimmed. In an illustrative example, the color temperature may shift from a cool white toward a warmer red or green as the intensity is dimmed by a simple exemplary phase control.

At the origin and up to conduction angle A, phase control does not attenuate the illuminance of LEDs1 or LEDs2. Accordingly, the light engine may output a composite color temperature that is a mix of the component color temperatures according to their relative intensities.

When the phase control delays conduction for angles between A and B, an average color temperature increases as the luminance of the low color temperature LEDs1 is decreased (see FIG. 6B).

When the phase control delays conduction for angles between B and C, the color temperature falls relatively rapidly as the increased phase cutting attenuates the higher color temperature toward zero. In this range, the lower color temperature LEDs1 falls relatively slowly, but not to zero.

When the phase control delays conduction for angles between C and D, the only contributing color temperature is T1, so the color temperature remains constant as the luminance of LEDs1 falls toward zero at D.

The example of FIG. 6C may cover embodiments in which the different color LEDs are spatially oriented and located to yield a composite color output. By way of an example, multiple colors of LEDs may be arranged to form a beam in which the illumination from each LED color substantially shares a common orientation and direction with other colors.

In some other embodiments, different color LEDs may be behave substantially as described in FIGS. 6A and 6B, yet may be spatially oriented so that their output illumination does not form a composite color that responds according to FIG. 6C. As an illustration, an exemplary light fixture may include LEDs1 and LEDs 2 that are spatially oriented to direct their illumination in orthogonal directions. By way of example and not limitation, one color of LEDs may be oriented downward from a ceiling toward the floor, and another color of LEDs may be oriented radially in a plane parallel to the floor. Accordingly, an exemplary shift in light engine color output may appear to have a spatial component.

In light of the foregoing, it may be seen that composite color temperature may be manipulated by controlling current flow through or diverting away from groups of LEDs. In various examples, manipulation of current flow through groups of LEDs may be automatically performed by one or more bypass circuits that are configured to be responsive to AC excitation levels. Moreover, various embodiments have been described that selectively divert current to improve power factor and/or reduce harmonic distortion, for example, for a given peak output illumination level. Bypass circuits have been described herein that may be advantageously implemented with existing LED modules or integrated into an LED module to form an LED light engine with only a small number of components, with low power, and low overall cost.

Accordingly, it may be appreciated from the disclosure herein that color temperature shifting may be implemented or designed based on appropriate selection of LED groups. The selection of the number of diodes in each group, excitation voltage, phase control range, diode colors, and peak intensity parameters may be manipulated to yield improved electrical and/or light output performance for a range of lighting applications.

Figure 7:
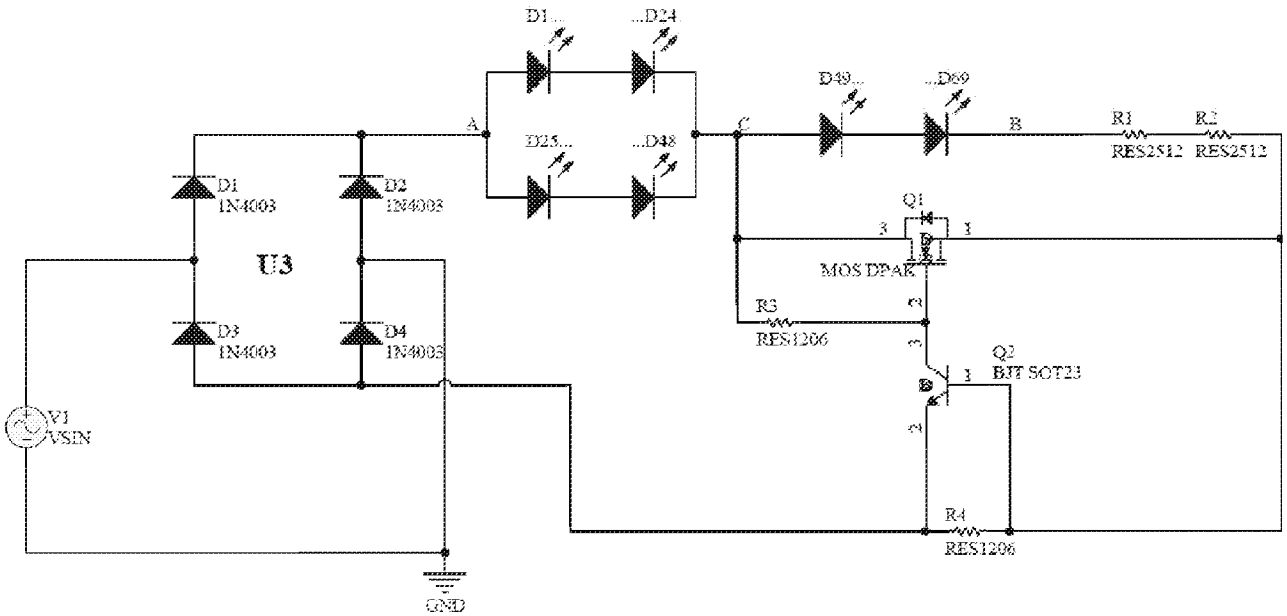
FIG. 7 shows a schematic of an exemplary circuit for an LED light engine with selective current diversion to bypass a group of LEDs while AC input excitation is below a predetermined level.

FIG. 7 shows a schematic of an exemplary circuit for an LED light engine with selective current diversion to bypass a group of LEDs while AC input excitation is below a predetermined level.

As depicted, the exemplary light engine includes a circuit 700 excited by an AC (e.g., substantially sinusoidal) voltage source V1. The AC excitation from the source V1 is rectified by diodes D1-D4. A positive output of the rectifier, at node A, supplies rectified current to a first set of LEDs, D1-D48, that are connected as a network of two parallel strings from node A to node C.

At node C, current may divide between a first path through a second set of LEDs and a second path through a current diversion circuit. The first path from node C flows through the second set of LEDs, D49-D69, to a node B, and then on through a series resistance, R1 and R2. In some embodiments, a peak current drawn from source V1 may depend substantially on the series resistance R1 and R2.

The second path from node C flows through a selective current diversion circuit that includes Q1, Q2, R3, and R4. In some examples, and with reference to FIG. 6A, the current drawn from the source V1 at intermediate excitation levels may depend substantially on the selective current diversion circuit.

The LEDs D1-D69 may be in a single module, or arranged as individual and/or groups of LEDs. The individual LEDs may output all the same color spectrum in some examples. In other examples, one or more of the LEDs may output substantially different colors than the remaining LEDs.

The number of LEDs is exemplary, and is not meant as limiting. The number of LEDs may be designed according to the forward voltage drop of the selected LEDs and the applied excitation amplitude supplied from the source V1. The number of LEDs in the first set between nodes A, C may be reduced to achieve an improved power factor. The LEDs between nodes A, C may be advantageously placed in parallel to substantially balance the loading of the two sets of LEDs according to their relative duty cycle, for example. In some implementations, current may flow from node A to C whenever input current is being drawn from the source V1, while the current between nodes C and B may flow substantially only around peak excitation from the source V1.

Figure 8:
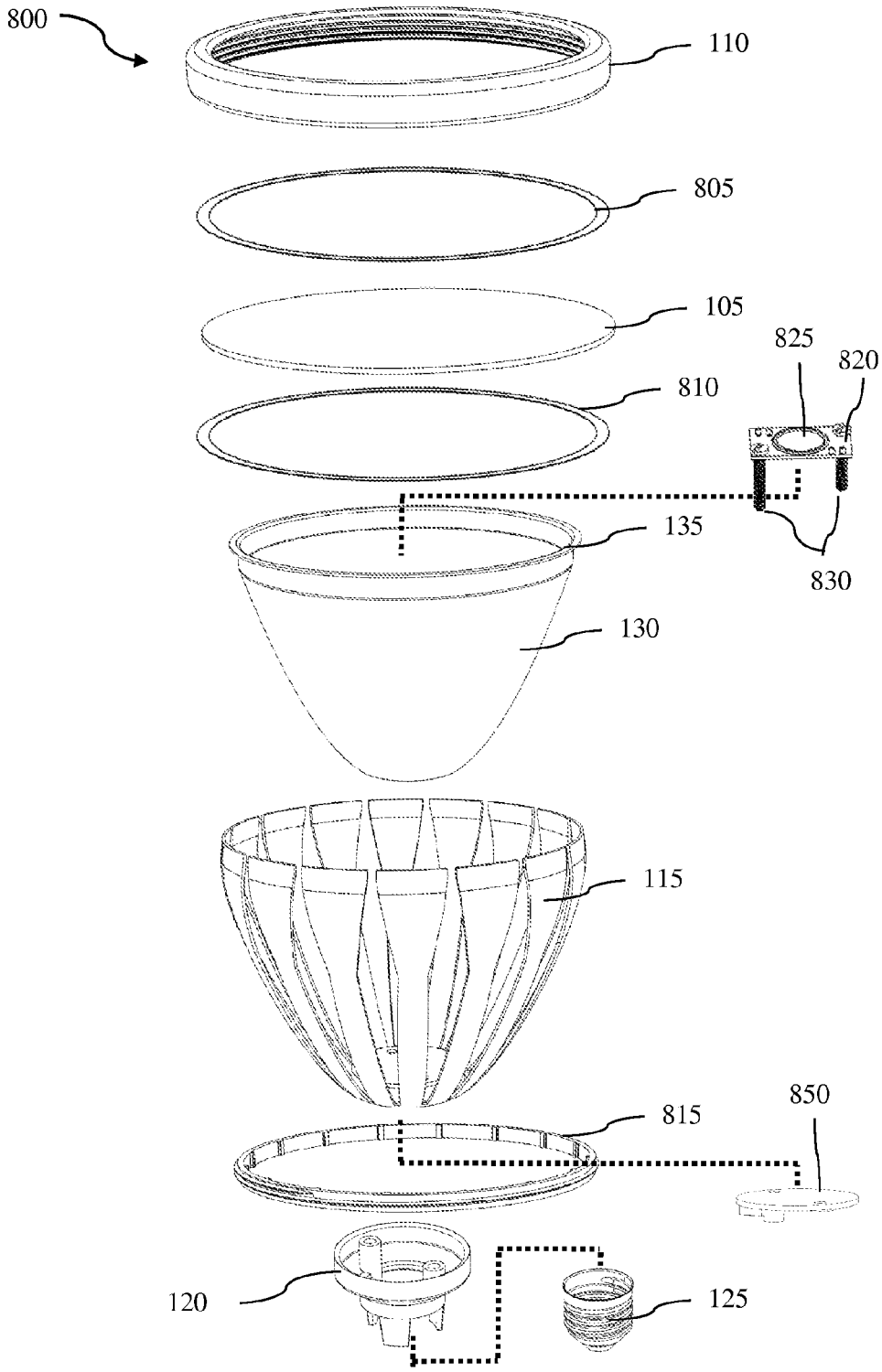
FIG. 8 shows an exploded view of components to illustrate construction of the lamp assembly of FIG. 1.

FIG. 8 shows an exploded view of components to illustrate construction of the lamp assembly of FIG. 1. In addition to the components identified with reference to FIG. 1, an assembly 800 further includes an upper sealing gasket 805, a lower sealing gasket 810, and a ring lock 815 that cooperate to form a seal at the distal (front) end of the light chamber. The ring lock 815 slides over the body shell 115 from the proximal end toward the distal end of the lamp 100. The sealing ring 100 may be threadedly coupled to the ring lock 815. When so engaged, the ring lock 815 is retained by the sealing ring 110 against a proximal surface of a peripheral rim 135 formed at the distal end of the reflector 130. When assembled, the sealing ring engages the upper seal gasket 805, which retains the lens 105 in compression against the lower seal gasket 810, which is in turn engaged on a distal surface of the peripheral rim 135. Sufficient compression may be maintained to provide a substantially sealed light chamber within the light chamber defined by the lens 105, the lower gasket seal 810, and the reflector 130.

Within the light chamber, the interior base surface supports a LED module 820 that converts electrical excitation to light output. With reference to the example of FIG. 7, the LED module 820 includes an electrical interface for making connection to nodes A, B, and C, for example, via flexible wiring and/or a board-to-board style header (not shown). The LED module 820 further includes an LED circuit 825 that includes the LEDs D1-D69. For various embodiments, suitable discrete or chip-type LEDs, such as model CL-L233-MC13L1, are commercially available for example from Citizen Electronics Co., Ltd. of Japan.

The LED module 820 receives excitation at the nodes A, B, C from an LED driver module 850. In this example, the LED driver module 850 may include the selective current diversion circuitry and rectifier discussed with reference to FIG. 7. As depicted in the example, an LED driver module 850 is mounted to a distally-extended central surface on the proximal end of the body shell 115. The distally-extended portion forms a pocket to receive the LED driver module 850, which may include a printed circuit board (PCB) assembly.

In some embodiments, the module 850 may be formed as a metal core PCB to promote heat transfer from its electrical components to the thermally conductive body shell 115. In some embodiments, the LED driver module may be substantially sealed by introduction of a potting compound that substantially protects the LED driver module 850 from contact with contaminants or liquids (e.g., water).

The LED module 820 is secured to the interior of the reflector 130 with two screws 830 that extent proximally to engage threaded holes in the base 120. In other examples, the LED module 820 may be secured using rivets that may also secure the reflector 130 to the body shell 115. Some implementations may secure one or more of the LED module 820, reflector 130, body shell 115, LED driver module 850, and/or base 120 using adhesives.

In some examples, thermally conductive materials may be provided to promote heat conduction among components. By way of example and not limitation, the interface between the distal surface of the LED driver module 850 and the proximal surface of the body shell 115, or the interface between the reflector 130 and the body shell 115, may include a thermally conductive pad. Thermal resistance between the LED driver module 850 and the body shell 115 may be further reduced by selection of a thermally conductive potting compound that is also substantially non-conductive. Thermally conductive grease may be provided at the interface of the LED module 820 and the reflector 130. Natural (e.g., convective) air flow around the surfaces of the members of the body shell 115 may advantageously provide substantial cooling to reduce temperature rise in the sealed LED light engine.

Figure 9:
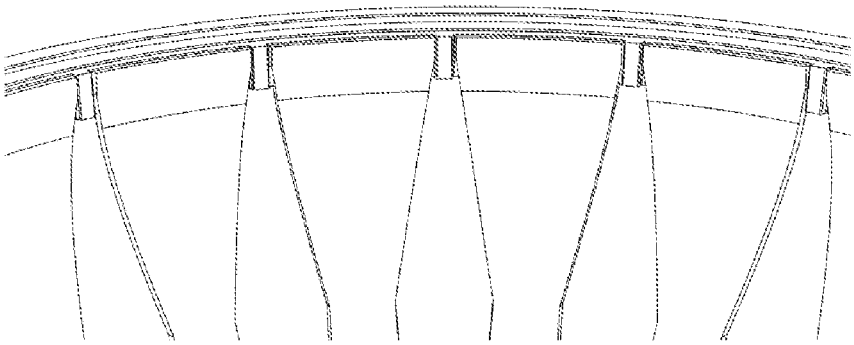
FIG. 9 shows a partial cut-away view showing detail of a sealing system at a distal end of the lamp assemblies of FIG. 1.

FIG. 9 shows a partial cut-away view showing detail of a sealing system at a distal end of the lamp assemblies of FIG. 1. The ring lock includes radially-inward-directed projections that fit into gaps between adjacent members of the body shell 115. The body shell 115 members engage the ring lock 815 to resist rotation while the sealing ring is rotationally threaded to engage the ring lock 815 during assembly.

Figure 10:
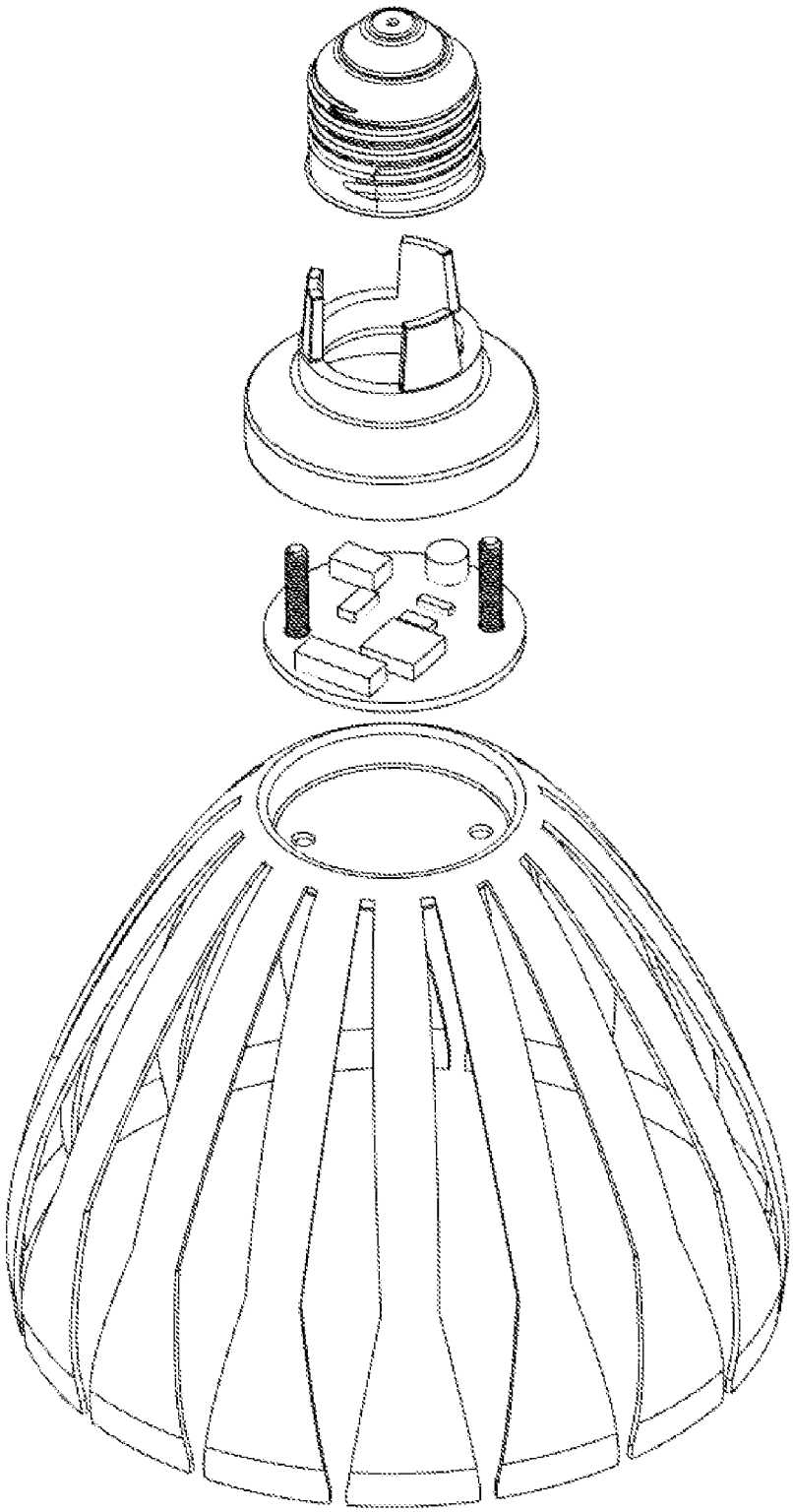
FIG. 10 shows an exploded view of components to illustrate construction of the proximal end of the lamp assembly of FIG. 1.

FIG. 10 shows an exploded view of components to illustrate construction of the proximal end of the lamp assembly of FIG. 1.

Figure 11:
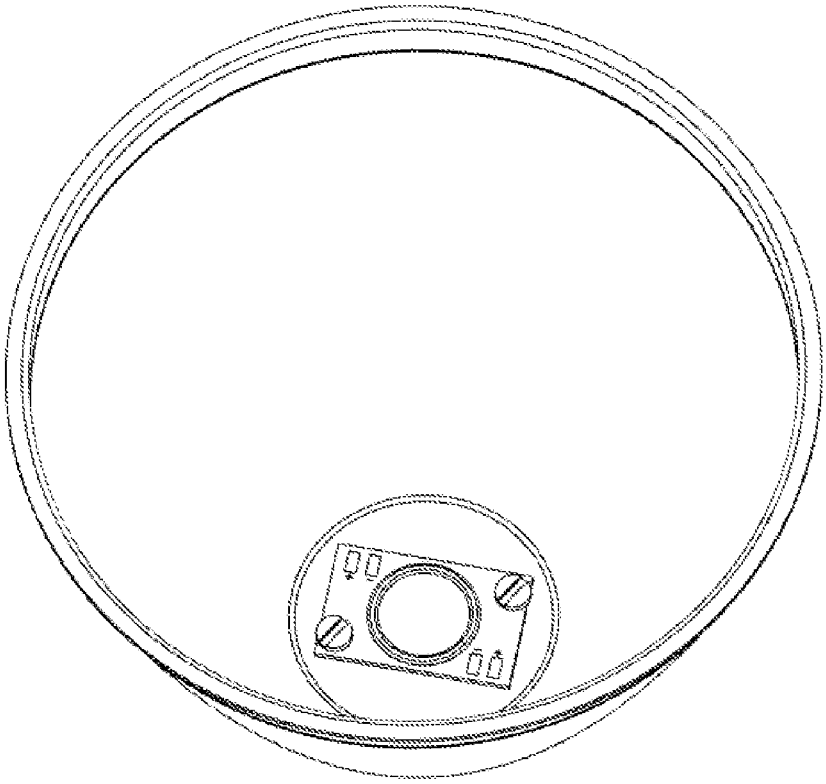
FIG. 11 shows a perspective view of an illustrative sub-assembly with LEDs installed in the reflector to illustrate construction of an exemplary distal end of the lamp assembly of FIG. 1.

FIG. 11 shows a perspective view of an illustrative sub-assembly with LEDs installed in the reflector to illustrate construction of an exemplary distal end of the lamp assembly of FIG. 1.

Figure 12:
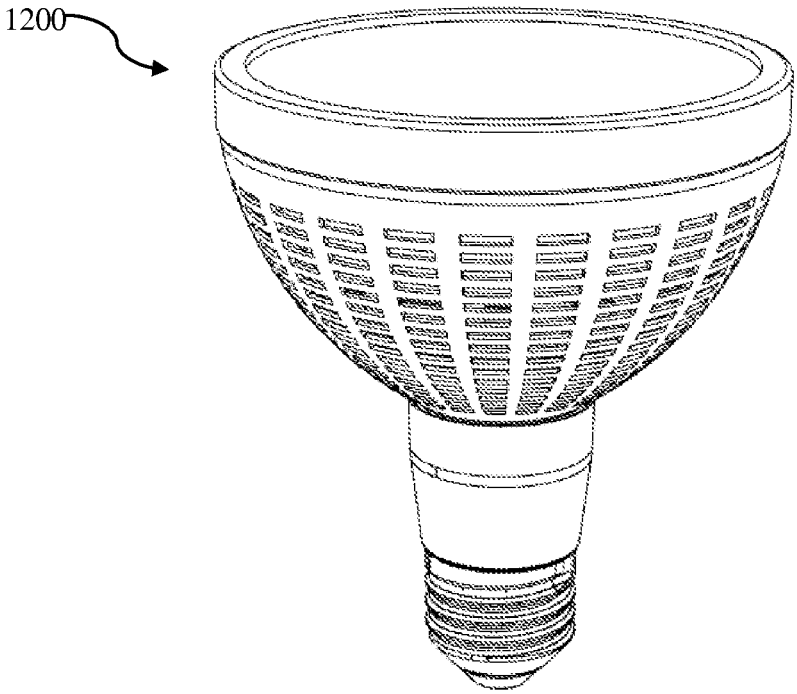
FIGS. 12-13 show another exemplary embodiment of an LED light engine assembled as a lamp.
Figure 13:
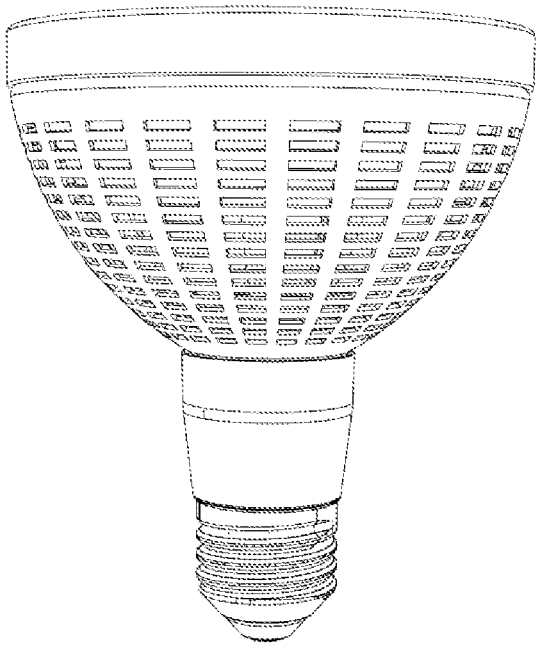

FIGS. 12-13 show another exemplary embodiment of an LED light engine assembled as a lamp 1200. By way of illustrative example and not limitation, the depicted lamp may be sized for compatibility or replacement of a PAR 30 or PAR 38 style lamp.

Figure 14:
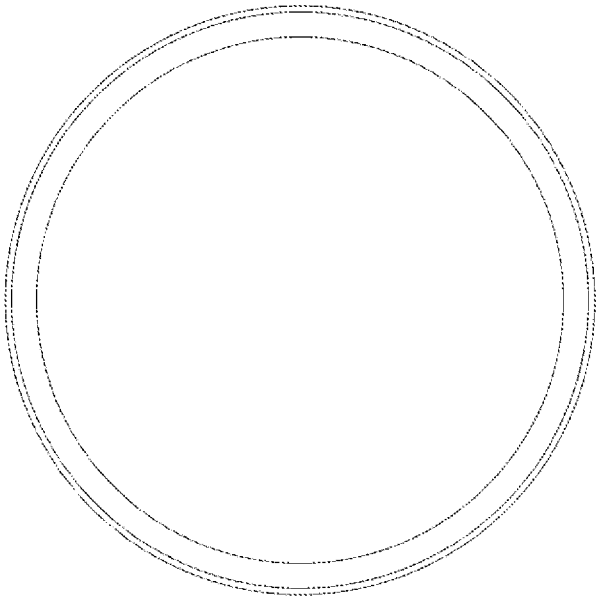
FIGS. 14-15 show distal and proximal views of the lamp assembly of FIG. 12.
Figure 15:
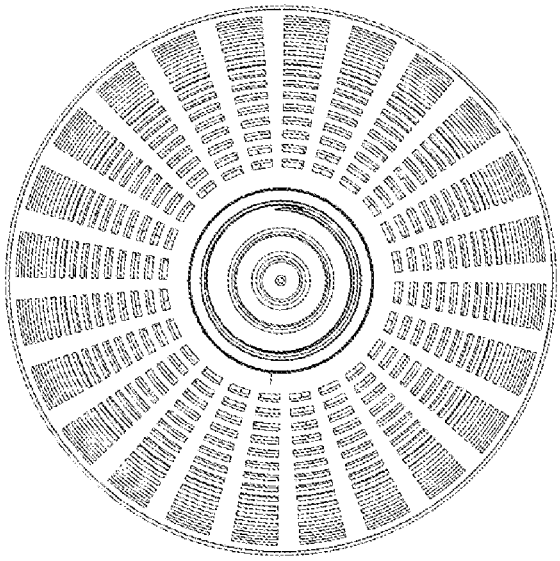

FIGS. 14-15 show distal and proximal views of the lamp assembly of FIG. 12.

Figure 16:
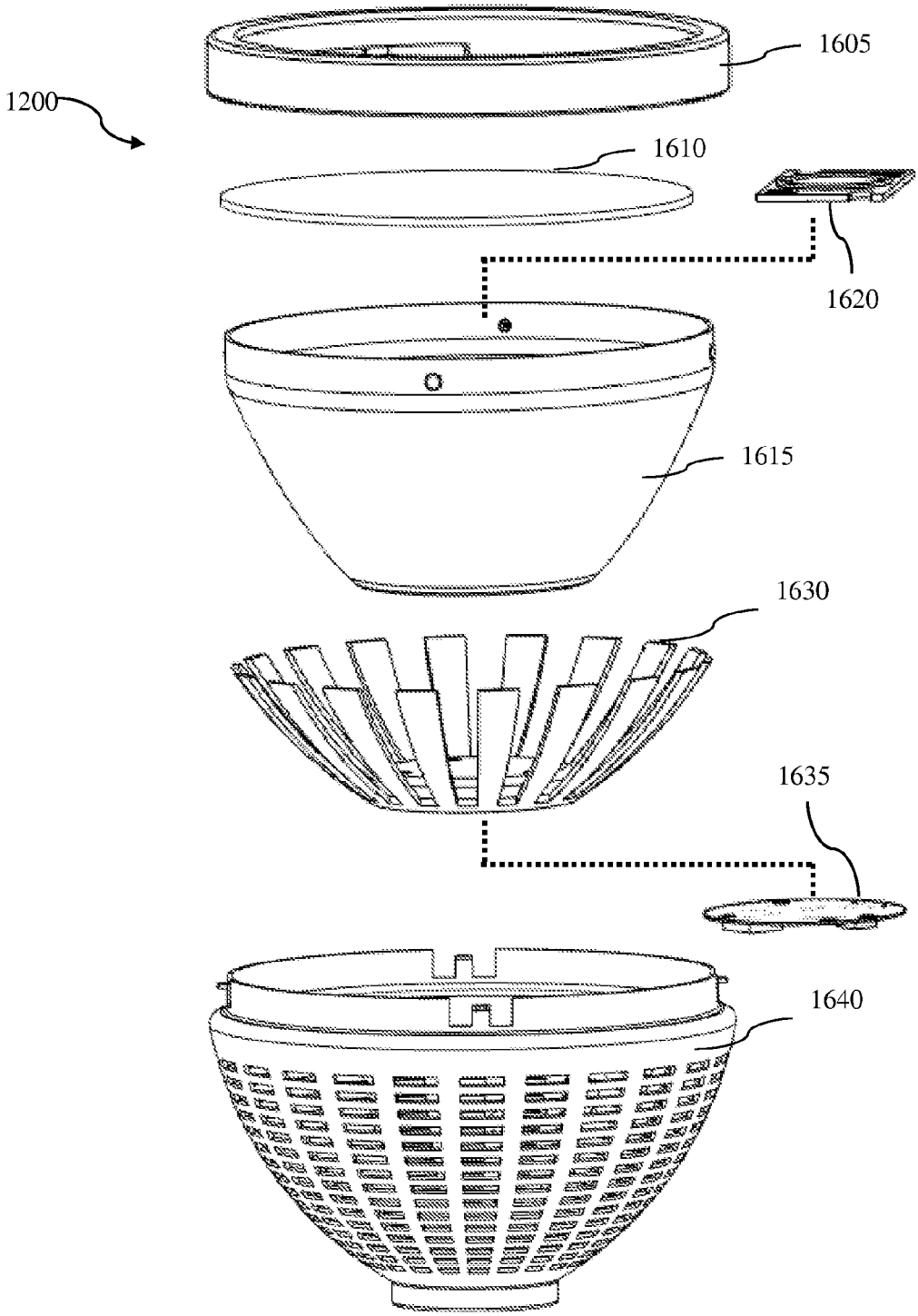
FIG. 16 shows an exploded view of components to illustrate an exemplary construction of the lamp assembly of FIG. 12.

FIG. 16 shows an exploded view of components to illustrate an exemplary construction of the lamp assembly of FIG. 12. An exemplary lamp assembly 1200 includes a sealing ring 1605 to retain a lens 1610 against a reflector 1615 to form a sealed light chamber. The reflector 11615 supports an LED module 1620 that converts electrical inputs to light. The reflector 1615 is in thermal communication with a thermal spreader 1630, which provides a substantial surface area and low thermal resistance to advantageously promote heat transfer away from the sealed LED light engine. A distally-extended pocket is formed in a central portion of the thermal spreader 1630 to receive an LED driver module 1635. In some embodiments, the LED driver module may be potted with potting compound to substantially seal that portion of the light engine circuitry against ingress of contaminants or liquids, for example. The depicted lamp assembly 1200 further includes a body shell 1640 as a housing around the light engine. The body shell 1640 provides for substantial convective or passive or forced air flow across at least the thermal spreader 1630 and the reflector 1615. This air flow, which may flow in any direction, may advantageously provide for substantial thermal exchange with ambient air, for example.

Figure 17A:
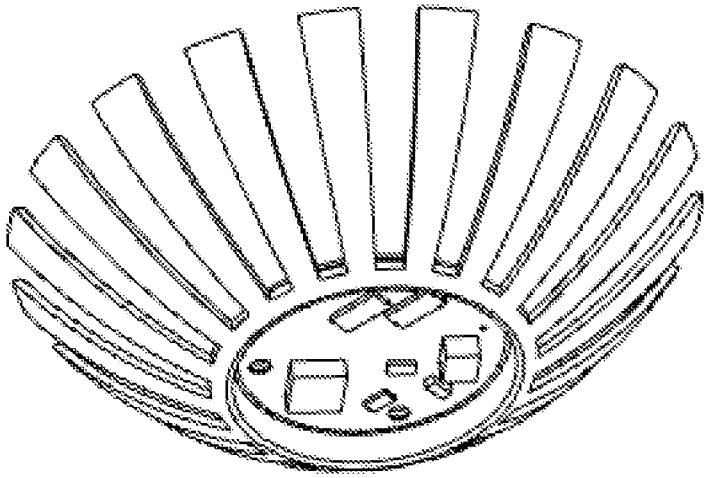
FIGS. 17A-17B show perspective views of an exemplary LED driver module assembled to an exemplary thermal dissipation module for the lamp assembly of FIG. 12.
Figure 17B:
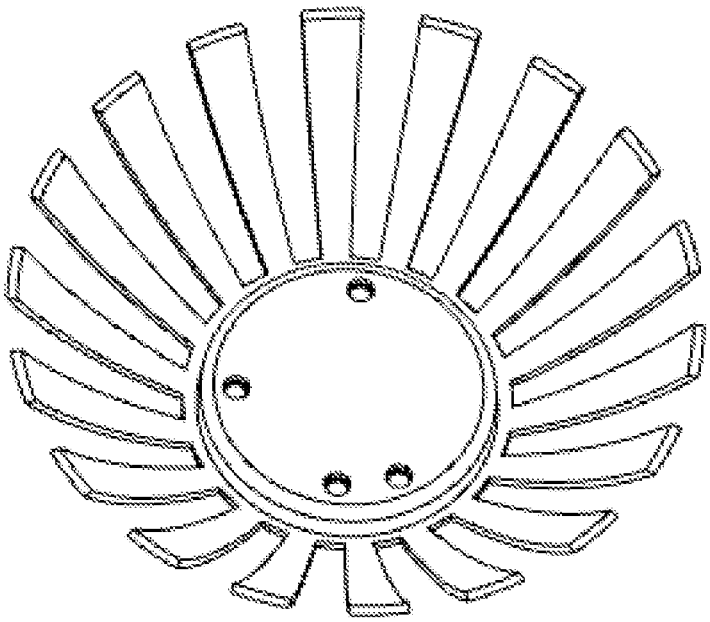

FIGS. 17A-17B show perspective views of an exemplary LED driver module, such as the LED driver module 1635, assembled to an exemplary thermal dissipation module, such as the thermal spreader 1630, for the lamp assembly of FIG. 12. The interface between the distal surface of the LED driver module 1635 and the proximal surface of the thermal spreader 1630 may include a thermally conductive medium, such as a thermal pad and/or thermally conductive grease or adhesive. Further thermal conductivity may be provided, for example, by inserting thermally conductive potting compound into the pocket that contains the LED driver module 1635.

Figure 18A:
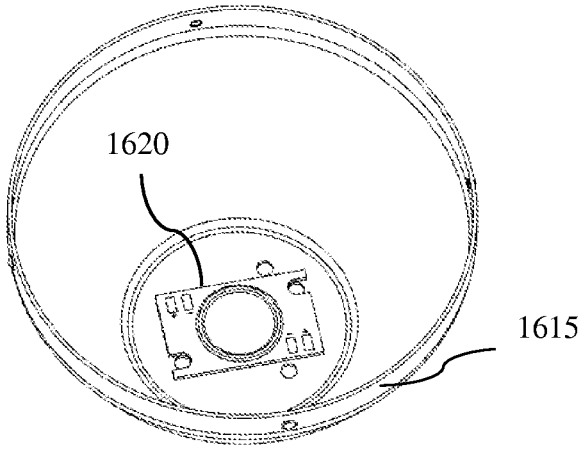
FIG. 18A shows a perspective view of an exemplary light chamber with an LED module assembled to a reflector for the lamp assembly of FIG. 12.

FIG. 18A shows a perspective view of an exemplary light chamber with an LED module 1620 assembled to the reflector 1615 for the lamp assembly of FIG. 12.

Figure 18B:
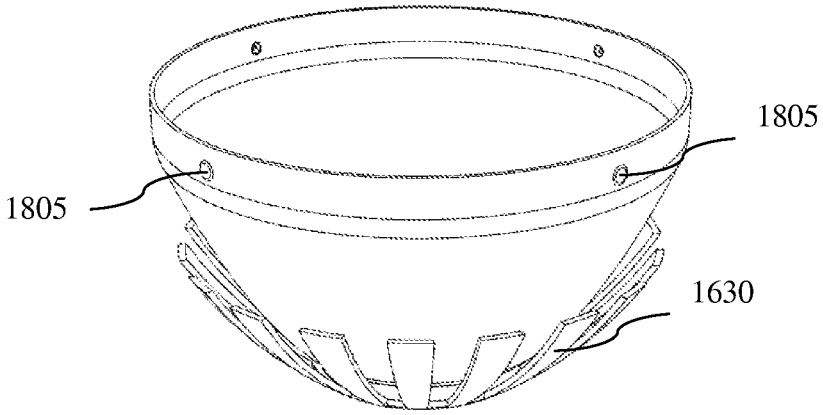
FIG. 18B shows a perspective view of the reflector of FIG. 18A in an exemplary sub-assembly with the thermal dissipation module of FIG. 17A.

FIG. 18B shows a perspective view of the reflector of FIG. 18A in an exemplary sub-assembly with addition of the thermal spreader 1630 to promote heat dissipation. The depicted reflector 1615 includes four detents that extend radially outward along the distal edge.

Figure 18C:
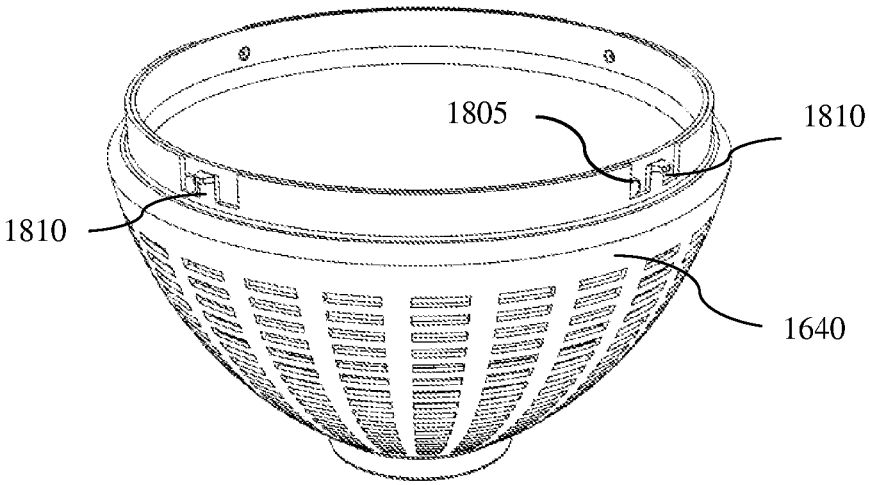
FIG. 18C shows a perspective view of the sub-assembly of FIG. 18B in an exemplary assembly with an outer shell.

FIG. 18C shows a perspective view of the sub-assembly of FIG. 18B in an exemplary assembly with the addition of the body shell 1640. The body shell 1640 has four radially-bent keys bent 1810 formed along its distal edge. Adjacent each key is a cut-out window to receive a corresponding detent 1805 of the reflector 1615. The detents 1805 provide support for the reflector within the interior volume of the body shell.

Figure 19:
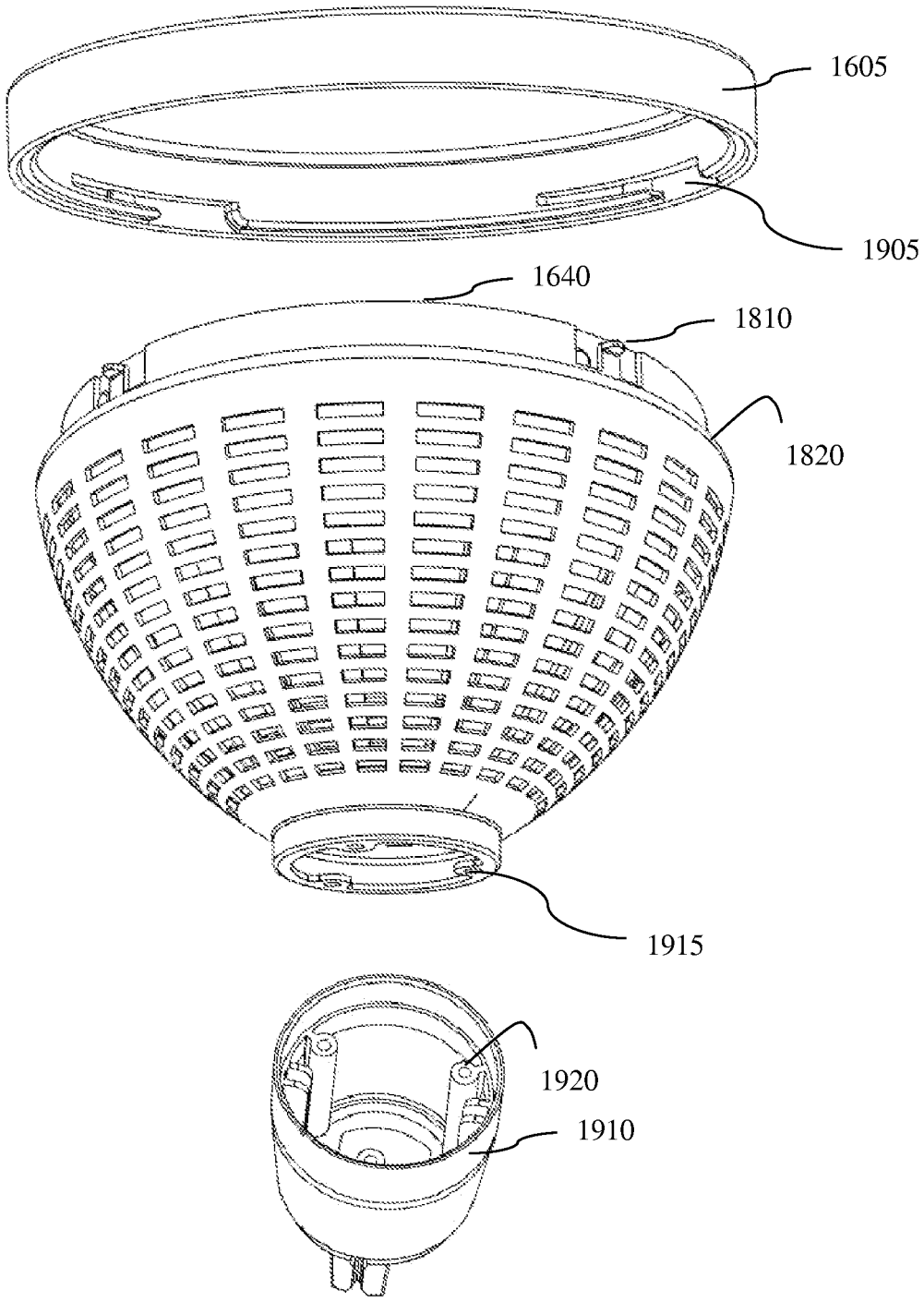
FIG. 19 shows a perspective view of assembly of FIG. 18C in an exploded view with a light chamber sealing system at a distal end of the lamp assembly of FIG. 12.

FIG. 19 shows a perspective view of assembly of FIG. 18C in an exploded view with a light chamber sealing system at a distal end of the lamp assembly of FIG. 12. During assembly, the sealing ring 1605 is installed to be seated on a shoulder 1820 of the body shell 1640. The sealing ring 1605 is rotated so that the keys 1810 engage corresponding capture slots 1905 on the inner perimeter of the sealing ring 1605.

A proximal central aperture of the body shell 1640 includes inwardly directed tabs with holes 1915 for screws that engage a base 1910. The base 1910 includes corresponding holes 1920 to engage the screws and retain the base 1910 in contact with the body shell 1640.

Figure 20:
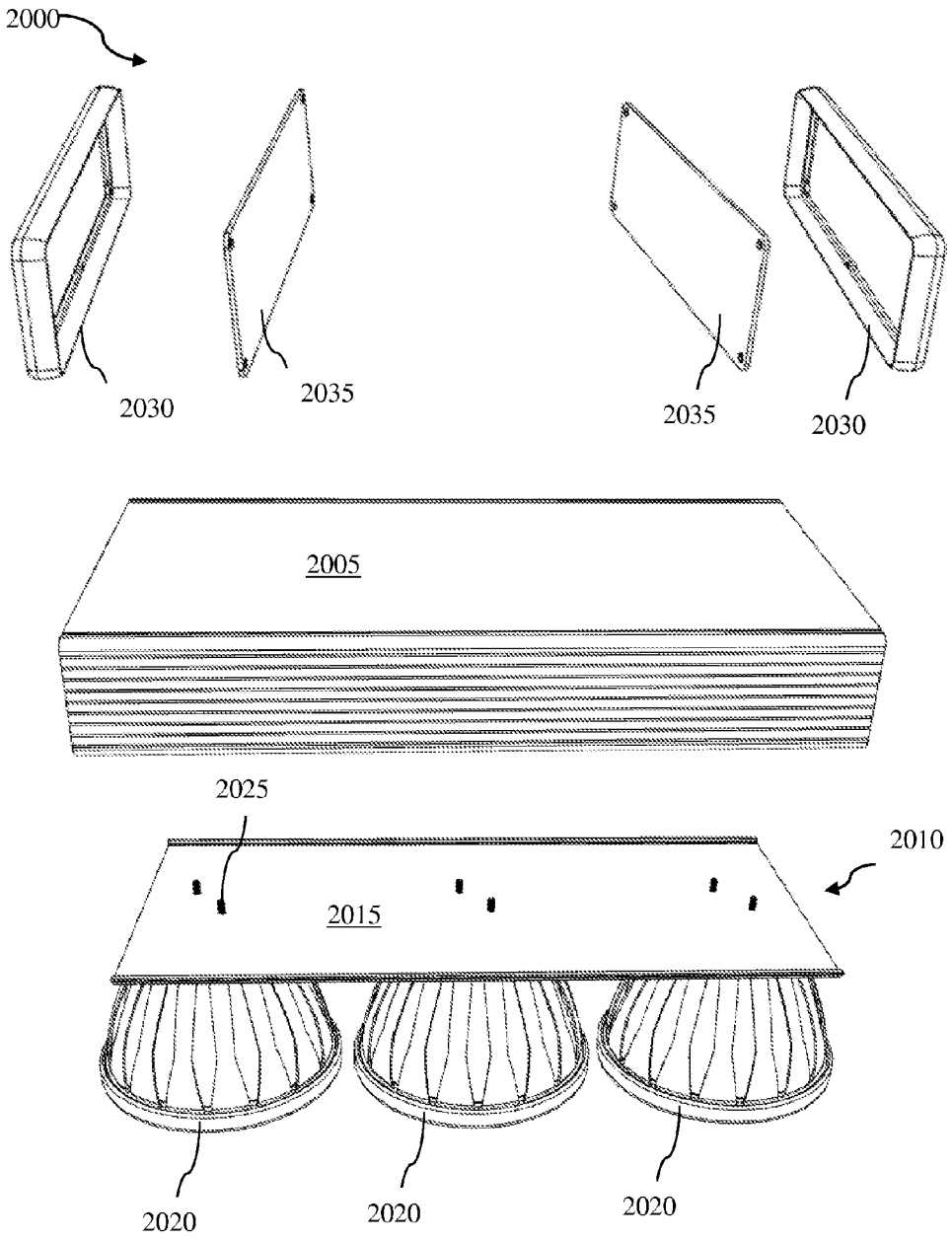
FIG. 20 shows an exemplary light assembly with multiple LED light engines mounted in an array to an enclosure.

FIG. 20 shows an exemplary light assembly with multiple LED light engines mounted in an array to an enclosure. In various embodiments, a light assembly 2000 includes a base 2005 and a light engine assembly 2010. The light engine assembly 2010 of this example is configured to be slidably received by the base 2005 so as to form a wall when in the base 2005. When so installed, the light 2000 can be made as an enclosure for the electrical connections to each lamp by installation of the end caps, each of which includes a bezel 2030 and an end plate 2035, in this example.

The base 2005 may be formed as an extrusion of plastic and/or metal (e.g., aluminum, steel), either alone or in a combination. In some embodiments the base may include surface treatments, such as anodizing or powder coating. The base 2005 may advantageously be highly thermally conductive and thus function as a substantial heat sink to transfer substantial heat energy away from the light engines 2020. For example, substantial heat transfer may occur via conduction from a base of each of the light engines 2020 to the support plate 2015, and further to the base 2005. Other heat transfer mechanisms, such as convection, radiation, and conduction, may promote substantial heat transfer from the light engines 2020 and/or the remainder of the light 2000.

The base 2005 may be configured with additional fixtures (not shown) to facilitate hanging or mounting. For example, a number of eye-hooks may be installed in one face of the base to permit attachment to supporting cables. Other commonly known mounting hardware may be readily installed by adhesive, for example, to the base 2005 in order to mount the light 2000.

The light assembly 2010 includes a support plate 2015 and a number of LED light engines 2020. In various examples, the number and arrangement of the LED light engines can be varied from one light engine 2020 to many light engines 2020. In some examples, the light engine assembly 2010 may include 1, 2, 3, 4, 5, 6, 7, 8, 9, 10, 11, 12, 13, 14, 15, 16, 17, 18, 19, 20, 21, 22, 23, 24, 25, 26, 27, 28, 29 or 30 lights installed on a single panel of the support plate 2015. The light engines may be arranged in rows and/or columns, polygons, or any custom-specified location on the support plate 2015. Each individual light engine may be dimmable, and may have an individually-selected color output as a function of electrical excitation.

Each of the light engines 2020 is mounted by two screws with nuts (not shown) to the support plate 2015. An additional hole (not shown) in the support plate 2015 may permit wiring to the light engines 2020. In some examples, the LED light engines 2020 may be adhesively attached to the support plate 2015. In a further example, the LED light engines 2020 may be releasably attached to the support plate 2015, for example, using a temporary adhesive system or a hook and/loop system sufficient to support the weight of the light engines 2020.

The base 2005 and/or any of the end plates 2035 may be modified to include a pluggable or strain-relief interface for receiving AC or DC electrical excitation. Some embodiments may further include one or more indicators, removable fuse holders, and/or user controls (e.g., switches, potentiometers) suitable for dimming control, for example.

In various embodiments, one or more bases 2005 may be joined to receive one or more of the light assemblies 2010. A connector strap (not shown) may be installed to connect adjacent bases 2005 so as to make an arbitrarily long base to receive a corresponding length of one or more of the light assemblies 2010.

Figure 21:
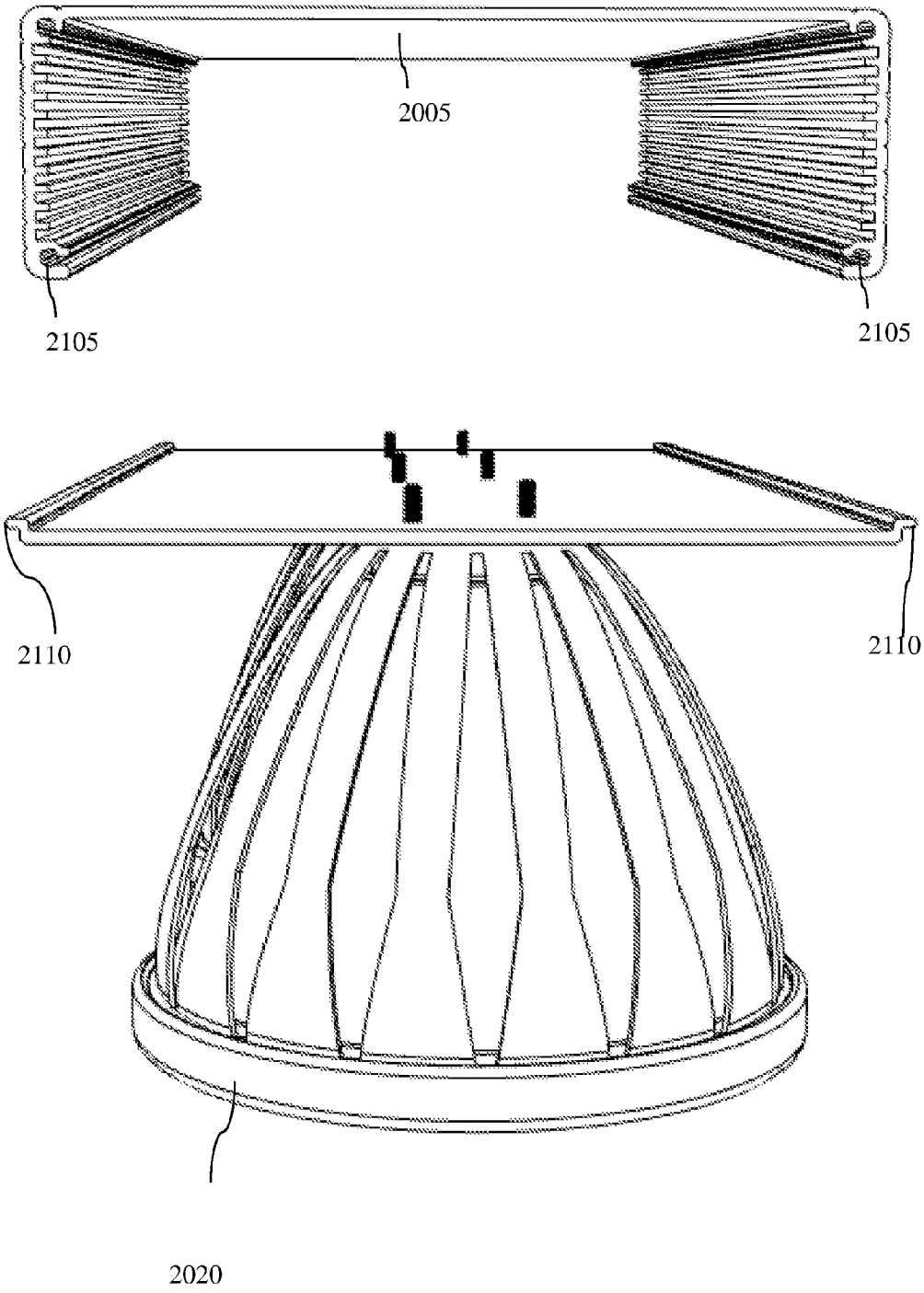
FIG. 21 shows an exemplary end view showing slidable installation of the light assembly into the base of FIG. 20.

FIG. 21 shows an exemplary end view showing slidable installation of the light assembly 2010 into the base 2005. The base 2005 includes tracks 2105 to receive lateral edges 2110 of the light assembly 2010. As an example, suitable components for the base 2005, light assembly 2010, and end cap pieces 2030, 2035 are commercially available from Hammond Manufacturing of Ontario, Canada.

Although various embodiments have been described with reference to the figures, other embodiments are possible. For example, although a screw type socket, which may sometimes be referred to as an "Edison-screw" style socket, may be used to make electrical interface to the LED light engine and provide mechanical support for the LED lamp assembly, other types of sockets may be used. Some implementations may use bayonet style interface, which may feature one or more conductive radially-oriented pins that engage a corresponding slot in the socket and make electrical and mechanically-supportive connection when the LED lamp assembly is rotated into position. Some LED lamp assemblies may use, for example, two or more contact pins that can engage a corresponding socket, for example, using a twisting motion to engage, both electrically and mechanically, the pins into the socket. By way of example and not limitation, the electrical interface may use a two pin arrangement as in commercially available GU-10 style lamps, for example.

Some bypass circuits implementations may be controlled in response to signals from analog or digital components, which may be discrete, integrated, or a combination of each. Some embodiments may include programmed and/or programmable devices (e.g., PLAs, PLDs, ASICs, microcontroller, microprocessor, digital signal processor (DSP)), and may include one or more data stores (e.g., cell, register, block, page) that provide single or multi-level digital data storage capability, and which may be volatile and/or non-volatile. Some control functions may be implemented in hardware, software, firmware, or a combination of any of them.

Computer program products may contain a set of instructions that, when executed by a processor device, cause the processor to perform prescribed functions. These functions may be performed in conjunction with controlled devices in operable communication with the processor. Computer program products, which may include software, may be stored in a data store tangibly embedded on a storage medium, such as an electronic, magnetic, or rotating storage device, and may be fixed or removable (e.g., hard disk, floppy disk, thumb drive, CD, DVD).

In some implementations, a computer program product may contain instructions that, when executed by a processor, cause the processor to adjust the color temperature and/or intensity of lighting, which may include LED lighting. Color temperature may be manipulated by a composite light apparatus that combines one or more LEDs of one or more color temperatures with one or more non-LED light sources, each having a unique color temperature and/or light output characteristic. By way of example and not limitation, multiple color temperature LEDs may be combined with one or more fluorescent, incandescent, halogen, and/or mercury lights sources to provide a desired color temperature characteristic over a range of excitation conditions.

Although some embodiments may advantageously smoothly transition the light fixture output color from a cool color to a warm color as the AC excitation supplied to the light engine is reduced, other implementations are possible. For example, reducing AC input excitation may shift average color temperature output of an LED fixture from a relatively warm color to a relatively cool color, for example.

In some embodiments, materials selection and processing may be controlled to manipulate the LED color temperature and other light output parameters (e.g., intensity, direction) so as to provide LEDs that will produce a desired composite characteristic. Appropriate selection of LEDs to provide a desired color temperature, in combination with appropriate application and threshold determination for the bypass circuit, can advantageously permit tailoring of color temperature variation over a range of input excitation.

In accordance with another embodiment, AC input to the rectifier may be modified by other power processing circuitry. For example, a dimmer module that uses phase-control to delay turn on and/or interrupt current flow at selected points in each half cycle may be used. In some cases, harmonic improvement may still advantageously be achieved even when current is distorted by the dimmer module. Improved power factor may also be achieved where the rectified sinusoidal voltage waveform is amplitude modulated by a dimmer module, variable transformer, or rheostat, for example.

In one example, the excitation voltage may have a substantially sinusoidal waveform, such as line voltage at about 120 VAC at 50 or 60 Hz. In some examples, the excitation voltage may be a substantially sinusoidal waveform that has been processed by a dimming circuit, such as a phase-controlled switch that operates to delay turn on or to interrupt turn off at a selected phase in each half cycle. In some examples, the dimmer may modulate the amplitude of the AC sinusoidal voltage (e.g., AC-to-AC converter), or modulate an amplitude of the rectified sinusoidal waveform (e.g., DC-to-DC converter).

In some implementations, the amplitude of the excitation voltage may be modulated, for example, by controlled switching of transformer taps. In general, some combinations of taps may be associated with a number of different turns ratios. For example, solid state or mechanical relays may be used to select from among a number of available taps on the primary and/or secondary of a transformer so as to provide a turns ratio nearest to a desired AC excitation voltage.

In some examples, AC excitation amplitude may be dynamically adjusted by a variable transformer (e.g., variac) that can provide a smooth continuous adjustment of AC excitation voltage over an operating range. In some embodiments, AC excitation may be generated by a variable speed/voltage electro-mechanical generator (e.g., diesel powered). A generator may be operated with controlled speed and/or current parameters to supply a desired AC excitation to an LED-based light engine, such as the light engine of FIG. 1, for example. In some implementations, AC excitation to the light engine may be provided using well-known solid state and/or electro-mechanical methods that may combine AC-DC rectification, DC-DC conversion (e.g., buck-boost, boost, buck, flyback), DC-AC inversion (e.g., half- or full-bridge, transformer coupled), and/or direct AC-AC conversion. Solid state switching techniques may use, for example, resonant (e.g., quasi-resonant, resonant), zero-cross (e.g., zero-current, zero-voltage) switching techniques, alone or in combination with appropriate modulation strategies (e.g., pulse density, pulse width, pulse-skipping, demand, or the like).

In an illustrative embodiment, a rectifier may receive an AC (e.g., sinusoidal) voltage and deliver substantially unidirectional current to LED modules arranged in series. An effective turn-on voltage of the LED load may be reduced by diverting current around at least one of the diodes in the string while the AC input voltage is below a predetermined level. In various examples, selective current diversion within the LED string may extend the input current conduction angle and thereby substantially reduce harmonic distortion for AC LED lighting systems.

In various embodiments, apparatus and methods may advantageously improve a power factor without introducing substantial resistive dissipation in series with the LED string. For example, by controlled modulation of one or more current paths through selected LEDs at predetermined threshold values of AC excitation, an LED load may provide increased effective turn on forward voltage levels for increased levels of AC excitation. For a given conduction angle, an effective current limiting resistance value to maintain a desired peak input excitation current may be accordingly reduced.

Various embodiments may provide reduced perceptible flicker to humans or animals by operating the LEDs to carry unidirectional current at twice the AC input excitation frequency. For example, a full-wave rectifier may supply 100 or 120 Hz load current (rectified sine wave), respectively, in response to 50 or 60 Hz sinusoidal input voltage excitation. The increased load frequency produces a corresponding increase in the flicker frequency of the illumination, which tends to push the flicker energy toward or beyond the level at which it can be perceived by humans or some animals. This may advantageously reduce stress related to flickering light.

In some examples, the LED light engine may further include a thermal transfer element with a thermally conductive base in substantial thermal communication with a proximal end of the reflector. The thermal transfer element may further include a plurality of thermally conductive members forming paths that extend around the sides of the reflector. In some embodiments, one or more thermally conductive members may extend forward from the base toward the distal of the reflector. Various embodiments may advantageously provide substantially increased surface area to promote heat transfer away from the sealed light chamber, for example, via heat transfer to air or other media.

In some embodiments, one or more of the thermally conductive members of the heat transfer element may extend substantially to the distal end of the reflector. In some embodiments, the inner seal ring may include one or more features that extend radially so as to mate with corresponding features formed by the one or more thermally conducting members.

In various embodiments, the intensity may be controllable, for example, in response to a light dimmer arranged to modulate AC excitation applied to the LED downlight. As the light intensity is decreased in response to a phase and/or amplitude control, the spectral output may, in some embodiments, shift its output wavelengths. In one example, the LED light may smoothly shift color output from substantially white at high intensity to substantially blue or green, for example, at a lower intensity. Accordingly, various exemplary installations may provide controlled combinations of intensity and color.

Some embodiments may provide a desired intensity and one or more corresponding color shift characteristics. Some embodiments may substantially reduce cost, size, component count, weight, reliability, and efficiency of a dimmable LED light source. In some embodiments, selective current diversion circuitry may operate with reduced harmonic distortion and/or improved power factor on the AC input current waveform using, for example, simple, low cost, and/or low power circuitry. Accordingly, some embodiments may reduce energy requirements for illumination, provide desired illumination intensity and color using a simple dimmer control, and avoid illumination with undesired wavelengths.

In some embodiments, the additional circuitry to achieve substantially reduced harmonic distortion may include a single transistor, or may further include a second transistor and a current sense element. In some examples, a current sensor may include a resistive element through which a portion of an LED current flows. In some embodiments, significant size and manufacturing cost reductions may be achieved by integrating the harmonic improvement circuitry on a die with one or more LEDs controlled by harmonic improvement circuitry. In certain examples, harmonic improvement circuitry may be integrated with corresponding controlled LEDs on a common die without increasing the number of process steps required to manufacture the LEDs alone. In various embodiments, harmonic distortion of AC input current may be substantially improved for AC-driven LED loads, for example, using either half-wave or full-wave rectification.

For example, in some embodiments a simple dimmer control may modulate a single analog value (e.g., phase angle, or amplitude) to provide a substantially desired intensity-wavelength illumination. For example, wavelengths for some embodiments may be selected, for example, to substantially emit optimal office illumination at higher AC excitation levels, and shift to a blue or red security lighting at energy-saving low AC excitation levels. In some implementations, some security cameras may have a relatively highly sensitivity, for example, to a wavelength emitted at the low AC excitation levels, thereby maintaining adequate lighting for security and electronic surveillance while permitting substantially reduced energy consumption during inactive hours, for example.

This document discloses technology relating to architecture for high power factor and low harmonic distortion of LED lighting systems. Related examples may be found in previously-filed disclosures that have common inventorship with this disclosure.

Examples of technology for improved power factor and reduced harmonic distortion for color-shifting LED lighting under AC excitation are described with reference, for example, to FIGS. 20A-20C of U.S. Provisional Patent Application (02P) entitled "Reduction of Harmonic Distortion for LED Loads," Ser. No. 61/233,829, which was filed by Z. Grajcar on Aug. 14, 2009, and for example the various circuits and controls of U.S. Provisional Patent Application (02) entitled "Reduction of Harmonic Distortion for LED Loads," Ser. No. 12/785,498, which was filed by Z. Grajcar on May 24, 2010, the entire contents of each of which are incorporated herein by reference.

Examples of technology for dimming and color-shifting LEDs with AC excitation are described with reference, for example, to the various figures or schematics of U.S. Provisional Patent Application (03P) entitled "Color Temperature Shift Control for Dimmable AC LED Lighting," Ser. No. 61/234,094, which was filed by Z. Grajcar on Aug. 14, 2009, and of U.S. patent application (03) entitled "Spectral Shift Control for Dimmable AC LED Lighting," Ser. No. 12/824,215, which was filed by Z. Grajcar on Jun. 27, 2010, the entire contents of each of which are incorporated herein by reference.

Although various embodiments of a sealed LED light engine have been described with a screw-type electrical socket interface, other electrical interfaces may be used. For example, a dual post electrical interface of the type used for GU 10 style lamps may be used. Instead of a can-type fixture, some embodiments may include a section of a track lighting-style receptacle to receive the dual post interface of an exemplary lamp. An example of an electrical interface that may be used in some embodiments of a downlight is disclosed in further detail with reference, for example, at least to FIG. 1, 2, 3, or 5 of U.S. Design patent application (06D) entitled "Lamp Assembly," Ser. No. 29/342,575, which was filed by Z. Grajcar on Oct. 27, 2009, the entire contents of which are incorporated herein by reference.

Further embodiments of LED light engines are described with reference, for example, at least to FIGS. 1, 2, 5A-5B, 7A-7B, and 10A-10B of U.S. Provisional Patent Application (16P) entitled "Architecture for High Power Factor and Low Harmonic Distortion LED Lighting," Ser. No. 61/255,491, which was filed by Z. Grajcar on Oct. 28, 2009, and to at least the various schematics figures, for example, of U.S. patent application (16) of the same title, with Ser. No. 12/914,575, which was filed by Z. Grajcar on Oct. 28, 20010, the entire contents of each of which are incorporated herein by reference.

Embodiments of an LED lamp assembly that includes a substantially sealed light engine and integrated thermal management are described, for example, at least with reference to FIGS. 8 and 16-19 of U.S. Provisional Patent Application (20P) entitled "Sealed LED Light Engines," Ser. No. 61/298,289, which was filed by Z. Grajcar on Jan. 26, 2010, and the entire contents of which are incorporated herein by reference.

Some embodiments may be integrated with other elements, such as packaging and/or thermal management hardware. Examples of thermal or other elements that may be advantageously integrated with the embodiments described herein are described with reference (28), for example, to FIG. 15 in U.S. Publ. Application 2009/0185373 A1, filed by Z. Grajcar on Nov. 19, 2008, the entire contents of which are incorporated herein by reference.

Further embodiments of implementations for exemplary LED light engine driver circuitry with depletion mode field effect transistors are described with reference, for example, at least to the various figures throughout U.S. Provisional Patent Application (41P) entitled "Current Conditioner with Reduced Total Harmonic Distortion," Ser. No. 61/435,258, which was filed by Z. Grajcar on Jan. 21, 2011, the entire contents of which are incorporated herein by reference.

A number of implementations have been described. Nevertheless, it will be understood that various modification may be made. For example, advantageous results may be achieved if the steps of the disclosed techniques were performed in a different sequence, or if components of the disclosed systems were combined in a different manner, or if the components were supplemented with other components. Accordingly, other implementations are contemplated within the scope of the following claims.

What is claimed is:

1. A method of fabricating a light source, the method comprising:

providing a predetermined number of sealed light engine modules (SLEMs), each SLEM comprising:

a) a lamp including a lens and a body shell where the body shell is seated on a distal end of a base member and a socket cup is fitted to a proximal end of the base member and the lamp is sealed with a sealing ring that mates with the lens and body shell to substantially resist the ingress of contaminants;

b) a light emitting diode (LED) module housed within the light chamber, wherein the LED module receives electrical excitation to convert the electrical excitation into light output;

mounting the SLEMs to a support plate of a light assembly;

slidably installing the light assembly into a base; and installing end caps onto the base to substantially contain an electrical interface of each of the mounted SLEMs.

2. The method of claim 1, further comprising making electrical connection to a pluggable socket for making connection to an excitation source.

3. The method of claim 2, further comprising performing the step of making electrical connection to the pluggable socket before performing the step of slidably installing the light assembly into the base.

4. The method of claim 1, further comprising selecting the predetermined number of SLEMs to meet a specified light output level.

5. The method of claim 1, further comprising modulating a color temperature of at least one of the SLEMs to provide a substantially smooth and continuous function of an amplitude of the electrical excitation.

6. The method of claim 1, further comprising modulating a color temperature of at least one of the SLEMs to provide a substantially smooth and continuous function of a phase modulation of the electrical excitation.

7. A light source comprising:

a predetermined number of sealed light engine modules (SLEMs), each SLEM comprising:

a) a lamp including a thermal spreader having a distally extended pocket formed in a central portion thereof that receives a LED module;

b) a lens and body shell where the lamp is sealed with a sealing ring that retains the lens against a reflector that is in thermal communication with the thermal spreader to substantially resist the ingress of contaminants; and c) a light emitting diode (LED) module housed within the light chamber, wherein the LED module is configured to receive electrical excitation from an electrical interface and to supply conditioned electrical excitation to provide light output;

a light assembly having a support plate configured to have the SLEMs mounted thereon;

a base configured to slidably receive the light assembly; and end caps configured to be installed onto the base to form an enclosed volume that substantially contains the electrical interface of each of the mounted SLEMs.

8. The light source of claim 7, wherein the lens is translucent.

9. The light source of claim 8, wherein the lens comprises an optical diffusive material.

10. The light source of claim 7, wherein the SLEM comprises a parabolic reflector.

* * * * *